US005431103A

United States Patent [19]

Hock et al.

[11] Patent Number: 5,431,103

[45] Date of Patent: Jul. 11, 1995

[54] GAS GENERANT COMPOSITIONS

[75] Inventors: Christopher Hock, Uintah; Michael P. Jordan, Bountiful; Virginia E. Chandler, Ogden; Robert D. Taylor, Hyrum; Thomas M. Deppert; Michael W. Barnes, both of Brigham City, all of Utah

[73] Assignee: Morton International, Inc., Chicago, Ill.

[21] Appl. No.: 310,019

[22] Filed: Sep. 21, 1994

Related U.S. Application Data

[63] Continuation-in-part of Ser. No. 207,922, Mar. 8, 1994, which is a continuation-in-part of Ser. No. 165,133, Dec. 10, 1993, abandoned.

[51] Int. Cl.[6] ..... C06B 45/00

[52] U.S. Cl. ..... 102/287; 102/290; 86/1.1

[58] Field of Search ..... 102/289, 290; 86/1.1

[56] References Cited

U.S. PATENT DOCUMENTS

| | | | |
|---|---|---|---|
| 4,369,079 | 1/1983 | Shaw | 149/2 X |
| 4,370,181 | 1/1983 | Lundstrom et al. | 149/2 X |
| 4,909,549 | 3/1990 | Poole et al. | 280/738 |
| 4,931,112 | 6/1990 | Wardle et al. | 149/88 |
| 4,948,439 | 8/1990 | Poole et al. | 149/46 |
| 5,035,757 | 7/1991 | Poole | 149/46 |
| 5,084,118 | 1/1992 | Poole | 149/22 |
| 5,139,588 | 8/1992 | Poole | 149/61 |
| 5,197,758 | 3/1993 | Lund et al. | 149/61 X |

*Primary Examiner*—Peter A. Nelson

*Attorney, Agent, or Firm*—Wayne E. Nacker; Gerald K. White

[57] ABSTRACT

A gas generant composition contains as a fuel a mixture of a major portion of a triazole or tetrazole and a minor portion of a water soluble fuel; and an oxidizer component, at least 20 wt % of said oxidizer component being a transition metal oxide, such as CuO. Generant compositions in accordance with the invention autoignite in a range around 170° C., providing autoignition of the generant without the need for separate autoignition devices. Also, the generant compositions are useful as autoignition pyrotechnic in autoignition devices.

2 Claims, 1 Drawing Sheet

GAS GENERANT COMPOSITIONS

This is a continuation in part of application Ser. No. 08/207,922 filed on Mar. 8, 1994 which is a continuation in part of U.S. Ser. No.08/165,133 filed on Dec. 10, 1993, abandoned.

The present Invention is directed to gas generant compositions for inflating automotive airbags and other devices in which rapid production of high volumes of gas is required. More particularly, the invention is directed to such compositions where tetrazoles and triazoles are the fuel component and oxidizers are selected to achieve a low combustion temperature so as to minimize production of toxic oxides during combustion.

Background of the Invention

Most automotive air bag restraint systems, presently in use, use gas generant compositions in which sodium azide is the principal fuel. Because of disadvantages with sodium azide, particularly instability in the presence of metallic impurities and toxicity, which presents a disposal problem for unfired gas generators, there is a desire to develop non-azide gas generant systems, and a number of non-azide formulations have been proposed. However, to date, non-azide gas generants have not made significant commercial inroads.

Alternatives to azides which have been proposed, e.g., in U.S. Pat. No. 5,035,757, the teachings of which are incorporated herein by reference, include azole compounds, including tetrazole and triazole compounds. Tetrazole compounds include 5-amino tetrazole (AT), tetrazole, bitetrazole and metal salts of these compounds. Triazole compounds include 1,2,4-triazole-5-one, 3-nitro 1,2,4-triazole-5-one and metal salts of these compounds. Although all of the above azole compounds are useful fuels in accordance with the present invention, AT is the most commercially important of these.

Gas generant systems include, in addition to the fuel component, an oxidizer. Proposed oxidizers for use in conjunction with azole fuels include alkali and alkaline earth metal salts of nitrates, chlorates and perchlorates. A problem with azole compound-based gas generant systems, heretofore proposed, is their high combustion temperatures. Generated levels of toxic oxides, particularly CO and $NO_x$ depend upon the combustion temperature of the gas-generating reaction, higher levels of these toxic gases being produced at higher temperatures. Accordingly, it is desirable to produce gas generant mixtures which burn at lower temperatures.

Several gas generant processing procedures utilize water. Water-processing reduces hazards of processing gas generant materials. It is therefore desirable that gas generant compositions be formulated so as to facilitate water processing.

One example of water processing, taught, e.g., in U.S. Pat. No. 5,015,309, the teachings of which are incorporated by reference, involves the steps of 1. Forming a slurry of the generant ingredients with water.
2. Spray drying the slurry to form spherical prills of diameter 100-300 microns.
3. Feeding the prills via gravity flow to a high speed rotary press.

In order to properly feed the tablet press, well formed spherical prills are needed. Without prills, plugging or bridging in the feed system is a common occurrence.

Without prills, it is difficult to achieve uniform, high speed filling of the tablet press. These prills will not form in the spray drying step without at least a portion of the generant being water soluble. Typical slurries contain up to 35% water and it is preferred that at least 15% of the solid ingredients need to be soluble in the slurry.

Another common production technique, (e.g. U.S. Pat. No. 5,084,218), the teachings of which are incorporated herein by reference, involves the following steps:

1. Forming a slurry of the generant ingredients with water.
2. Extruding the slurry to form spaghetti like strands.
3. Chopping and spheronizing the strands into prills.
4. Tableting of the prills as described previously.

The chopping and spheronizing step to form prills will not be successful unless a portion of the generant is water soluble.

SUMMARY OF THE INVENTION

Gas generant compositions comprise between about 20 and about 40 wt % of a fuel and between about 20 and about 80 wt % of an oxidizer; balance, option additional components. Between about 50 and about 85 wt % of the fuel is a triazole or tetrazole, between about 15 and about 50 wt % of the fuel is a water-soluble fuel such as guanidine nitrate, ethylene diamine dinitrate or similar compounds. At least about 20 wt % of the oxidizer up to 100%, preferably at least about 50 wt %, comprises a transition metal oxide; balance alkali and/or alkaline earth metal nitrates, chlorates or perchlorates. The use of transition metal oxides as a major oxidizer component results in lower combustion temperatures, resulting in lower production of toxic oxides.

Compositions in accordance with the invention autoignite at temperatures in a range around 170° C., whereby the use of these compositions as generants in inflators can obviate the need for distinct autoignition units, as are generally used in aluminum-housed inflators.

Also, the compositions in accordance with the invention can be used as autoignition material in autoignition units for inflators utilizing conventional generants, such as azide-based generants.

DETAILED DESCRIPTION OF CERTAIN PREFERRED EMBODIMENTS

Figure 1:
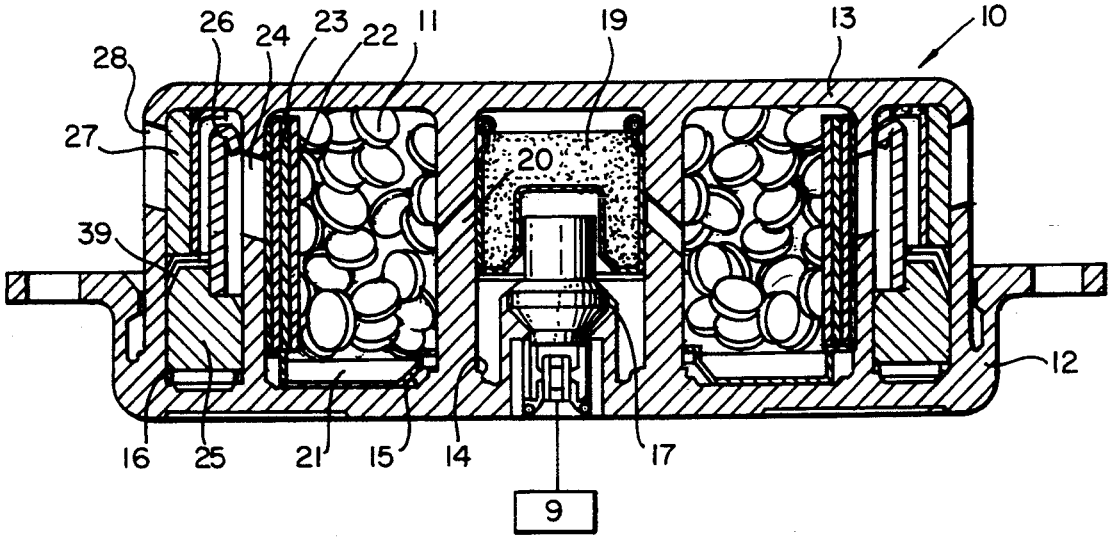
FIG. 1 is a cross-sectional view of an inflator module adapted for use in the hub of a steering wheel, this inflator module having no distinct autoignitor unit.

Herein, unless otherwise stated, all percentages herein are by weight.

While the major fuel component may be selected from any of the tetrazole and triazole compounds listed above and mixtures thereof, from an availability and cost standpoint, 5-aminotetrazole (AT) is presently the azole compound of choice, and the invention will be described herein primarily in reference to AT. The purpose of the fuel is to produce carbon dioxide, water and nitrogen gases when burned with an appropriate oxidizer or oxidizer combination. The gases so produced are used to inflate an automobile gas bag or other such device. By way of example, AT is combusted to produce carbon dioxide, water and nitrogen according to the following equation:

$$2CH_3N_5+7/2O_2\rightarrow 2CO_2+3H_2O+5N_2.$$

To facilitate processing in conjunction with water, a minor portion of the fuel, i.e., between about 15 and about 50 wt % of the fuel, is water soluble. While water-soluble oxidizers, such as strontium nitrate also facilitate water-processing, over-reliance on such water-soluble oxidizers tend to produce undesirably high combustion temperatures. Specific desirable characteristics of water soluble fuels are:

The compound should be readily soluble in water, i.e., at least about 30 gm/100 ml. $H_2O$ at 25° C.;

The compound should contain only elements selected from H, C, O and N;

When formulated with an oxidizer to stoichiometrically yield carbon dioxide, nitrogen, and water, the gas yield should be greater than about 1.8 moles of gas per 100 grams of formulation; and When formulated with an oxidizer to stoichiometrically yield carbon dioxide, water and nitrogen, the theoretical chamber temperature at 1000 psi should be low, preferably, less than about 1800° K.

Compounds that most ideally fit the above criteria are nitrate salts of amines or substituted amines. Suitable compounds include, but are not limited to, the group consisting of guanidine nitrate, aminoguanidine nitrate, diaminoguanidine nitrate, semicarbazide nitrate, triaminoguanidine nitrate, ethylenediamine dinitrate, hexamethylene tetramine dinitrate, and mixtures of such compounds. Guanidine nitrate is the currently preferred water-soluble fuel.

Generally any transition metal oxide will serve as an oxidizer. Particularly suitable transition metal oxides include ferric oxide and cupric oxide. The preferred transition metal oxide is cupric oxide which, upon combustion of the gas generant, produces copper metal as a slag component. The purpose of the oxidizer is to provide the oxygen necessary to oxidize the fuel; for example, CuO oxidizes AT according to the following equation:

$$4CH_3N_5+14CuO\rightarrow 14Cu+4CO_2+6H_2O+10N_2.$$

The transition metal oxide may comprise the sole oxidizer or it may be used in conjunction with other oxidizers including alkali and alkaline earth metal nitrates, chlorates and perchlorates and mixtures of such oxidizers. Of these, nitrates (alkali and/or alkaline earth metal salts) are preferred. Nitrate oxidizers increase gas output slightly. Alkali metal nitrates are particularly useful as ignition promoting additives.

It is frequently desirable to pelletize the gas generant composition. If so, up to about 5 wt %, typically 0.2–5 wt % of a pressing aid or binder may be employed. These may be selected from materials known to be useful for this purpose, including molybdenum disulfide, polycarbonate, graphite, Viton, nitrocellulose, polysaccharides, polyvinylpyrrolidone, sodium silicate, calcium stearate, magnesium stearate, zinc stearate, talc, mica minerals, bentonite, montmorillonite and others known to those skilled in the art. A preferred pressing aid/binder is molybdenum disulfide. If molybdenum disulfide is used, it is preferred that an alkali metal nitrate be included as a portion of the oxidizer. Alkali metal nitrate in the presence of molybdenum disulfide results in the formation of alkali metal sulfate, rather than toxic sulfur species. Accordingly, if molybdenum disulfide is used, alkali metal nitrate is used as a portion of the oxidizer in an amount sufficient to convert substantially all of the sulfur component of the molybdenum disulfide to alkali metal sulfate. This amount is at least the stoichiometric equivalent of the molybdenum disulfide, but is typically several times the stoichiometric equivalent. On a weight basis, an alkali metal nitrate is typically used at between about 3 and about 5 times the weight of molybdenum disulfide used.

The gas generant composition may optionally contain a catalyst up to about 3 wt %, typically between about 1 and about 2 wt %. Boron hydrides and iron ferricyanide are such combustion catalysts. Certain transition metal oxides, such as copper chromate, chromium oxide and manganese oxide, in addition to the oxidizer function, further act to catalyze combustion.

To further reduce reaction temperature, coolants may also optionally be included at up to about 10 wt %, typically between about 1 and about 5 wt %. Suitable coolants include graphite, alumina, silica, metal carbonate salts, transition metals and mixtures thereof. The coolants may be in particulate form, although if available, fiber form is preferred, e.g., graphite, alumina and alumina/silica fibers.

An additional advantage of compositions in accordance with the invention is that they have an autoignition temperature of in a range around 170° C. i.e. between about 155° C. and about 180° C. This corresponds with an autoignition temperature range particularly desirable for effecting autoignition in an aluminum inflator. With autoignitable gas generant material in thermal communication with the housing, the gas generant material will autoignite when the housing is exposed to abnormally high temperatures, e.g. in the range of about 240° C.

Figure 2:
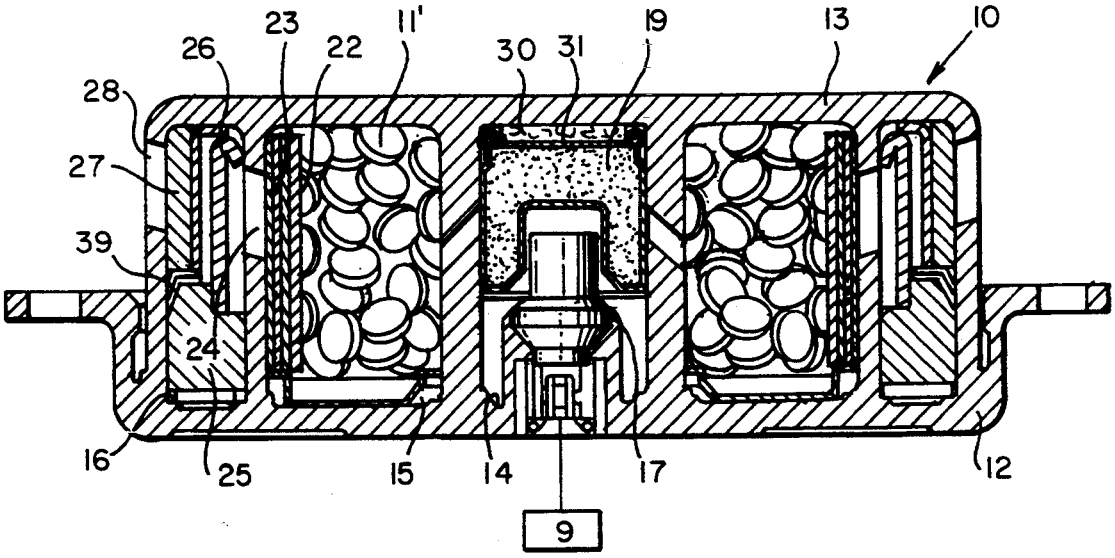
FIG. 2 is a cross-sectional view of an inflator module adapted for use in the hub of a steering wheel, this inflator module having an autoignitor unit.

U.S. Pat. No. 4,561,675, the teachings of which are incorporated herein by reference, describes the hazard posed by aluminum housed inflators when subjected to temperatures such as might be reached in an auto fire. The aluminum housing weakens at a temperature below the temperature whereat conventional gas generant materials, particularly azide-based generants, autoignite. Accordingly, there would be the possibility of the inflator bursting or shattering, sending fragments flying. However, U.S. Pat. No. 4,561,675 addresses this problem by providing an autoignition device which contains pyrotechnic material which autoignites below the temperature whereat the aluminum housing weakens and, in turn, ignites the main generant material. A unit having an autoignition unit is shown in FIG. 2. Generally all aluminum inflators currently sold incorporate such an autoignition unit.

Because the gas generant materials of the present invention autoignite in a range around 170° C., there is no need to provide a distinct autoignition unit, as the gas generant itself autoignites at temperatures below aluminum housing weakening temperatures. Obviating the need for a distinct autoignition unit, reduces costs. Also, greater design flexibility is permitted.

Illustrated in FIG. 1 is a cross-section of an inflator unit 10 which utilizes generant pellets 11, formulated in accordance with the present invention, as a gas generant that also autoignites. Inflator units without specific autoignition units are known in the art, e.g., U.S. Pat. No. 4,547,342, the teachings of which are incorporated herein by reference; however, such units utilizing generants which do not autoignite below aluminium weakening temperatures represent a hazard in fire situations.

The housing is formed from two aluminum pieces, a base 12 and a diffuser 13, welded together. The diffuser 13 is configured to define a central cylindrical chamber 14 and annular chambers 15 and 16. Within the central chamber is a squib 17 containing pyrotechnics. The squib 17 is connected by an electrical connector 18 to sensor means, represented by a box 9, which detects when the vehicle has been in a collision, and the pyrotechnics in the squib are ignited. Opposite the squib 17 in the central chamber 14 is a cup 19 containing ignitor material, such as B and $KNO_3$. The squib 17, upon ignition, bursts, releasing gases which ignite the ignitor material in the cup 19. The ignitor cup 19 then bursts, releasing gasses through radial diffuser passageways 20 to annular chamber 15 wherein the pellets 11 of gas generant material are contained. A generant retainer 21 at the base side of chamber 15 is a construction expedient, retaining the gas generant within the diffuser 13 until it is joined with the base 12. Surrounding the pellets 11 is a combustion screen or filter 22, and surrounding this is an adhesive-backed foil seal 23 which hermetically seals the pellets within the inflator, protecting them from ambient conditions, such as moisture. When the generant pellets 11 are ignited, gases pass through the screen 22, rupture the foil seal 23 and pass into the outer annular chamber 16 through passageways 24. At the base end of chamber 16 is a wire filter 25 for catching and retaining slag and particles formed during combustion. Gas is directed into the filter 25 by a deflector ring 26. After passing through the filter 25, the gas passes around a baffle 39, which deflects the gas through a secondary filter 27, and out through passageways 28 to the airbag (not shown).

Shown in FIG. 2 is an inflator, similar to that of Figure 1, but which uses the gas generant composition of the present invention in an autoignition unit 30 when gas generant pellets 11' of conventional composition, such as azide-based, are used as the primary generant. (In FIG. 2, identical parts are designated with the same reference numerals used in FIG. 1.) The autoignition unit 30 is a cap at the end of the cup 14 which holds the ignitor material. The top of the autoignition unit 30 is in contact with the diffuser 13 so that the autoignition material is in thermal communication with the housing. The autoignition material, i.e., the generant composition in accordance with the invention, is separated from the ignitor material by a frangible membrane 31, e.g. foil. Should the unit be exposed to excessive temperatures, such as might be encountered in a vehicle fire, the autoignition material ignites, bursting membrane 31, resulting in events leading to full gas generation according to the sequence set forth above.

The compositions of the present invention have long-term stability. Thus, they are preferable to autoignition materials, such as nitrocellulose-based autoignition materials which degrade over time. The compositions are non-explosive, thus preferable to explosive autoignition materials.

The invention will now be described in greater detail by way of specific examples.

Example 1-3

Gas generant compositions are formulated according to the table below (amounts in parts by weight, excluding molybdenum sulfide binder). The compositions were prepared by mixing the components in an aqueous slurry (approximately 70% solids), drying the composition, and screening the dried mixture. Burn rate slugs were pressed and burning rate measured at 1000 psi.

| | 1 | 2 | 3 | |
|---|---|---|---|---|
| Guanidine nitrate | 9.84 | 10.84 | 11.82 | Soluble Fuel |
| Cupric oxide | 70.94 | 70.48 | 70.03 | Oxidizer |
| 5-Aminotetrazole | 17.73 | 17.20 | 16.67 | Fuel |
| Sodium nitrate | 1.48 | 1.48 | 1.48 | Oxidizer (low ignition temperature) |
| Molybdenum disulfide | 0.5 | 0.5 | 0.5 | |
| The following are properties of the compositions: | | | | |
| Burning rate at 1000 psi (ips) | 0.78 | 0.79 | 0.79 | |
| Chamber Temp. (°K.) | 1653 | 1651 | 1648 | |
| % Soluble (30% Slurry) | 19.6 | 21.0 | 22.4 | |
| Slag | well formed (all compositions) | | | |
| Auto Ignition temp. | 160° C. | 160° C. | 160° C. | |

Example 4

Three inflators as shown in FIG. 2 were assembled using the composition of Example 3 above. The inflators were put on stacks of firewood which were ignited. After a period of time the inflators deployed normally due to the autoignition of composition of the present invention, autoignition propagating the rest of the ignition sequence. Typically in a test of this type, an inflator in which the autoignition fails, fragments due to the reduction in strength of the housing at bonfire temperatures.

What is claimed is:

1. A method of producing high volumes of gas to an automotive airbag during a vehicular collision and also provide for generation of high volumes of gas during vehicular fire conditions, the method comprising providing an inflator unit comprising a housing, gas generant contained within said housing, means for igniting said gas generant during a vehicular collision, and means to vent gases generated by gas generant combustion to the airbag, said gas generant comprising between about 20 and about 40 wt % of fuel, said fuel comprising a tetrazole and/or triazole compound at between about 50 and about 85 wt % of said fuel and a water-soluble fuel at between about 15 and about 50 wt % of said fuel; between about 20 and about 80 wt % of oxidizer, at least about 20 wt % and up to 100% of said oxidizer being a transition metal oxide or mixture of transition metal oxides, the balance of said oxidizer being an alkali and/or alkaline earth metal nitrate, chlorate, perchlorate or mixture thereof; and, any balance comprising additional gas generant-compatible components, said gas generant autoigniting at temperatures of between about 155° C. and about 180° C., whereby autoignition occurs in the absence of other autoignition material.

2. In an automotive airbag inflator comprising a housing, electrically ignitable squib means for generating hot gases, ignition material for producing additional hot gases disposed within said housing for ignition upon exposure to hot gases generated by said squib means, and gas generant material for producing high volumes of gases disposed within said housing for ignition upon exposure to hot gases generated by said ignition material, a method for igniting said ignition material when said housing is exposed to abnormally high temperatures, The method comprising disposing in said housing an autoignition material in thermal communication with said housing and disposed so as to ignite said ignition material when said autoignition material ignites, said autoignition material comprising between about 20 and about 40 wt % of fuel, said fuel comprising a tetrazole and/or triazole compound at between about 50 and about 85 wt % of said fuel and a water-soluble fuel at between about 15 and about 50 wt % of said fuel; between about 20 and about 80 wt % of oxidizer, at least about 20 wt % and up to 100% of said oxidizer being a transition metal oxide or mixture of transition metal oxides, the balance of said oxidizer being an alkali and/or alkaline earth metal nitrate, chlorate, perchlorate or mixture thereof; and, any balance comprising additional gas generant-compatible components.

* * * * *